US008740112B2

(12) United States Patent
Blum et al.

(10) Patent No.: US 8,740,112 B2
(45) Date of Patent: Jun. 3, 2014

(54) SANITARY FUNCTIONAL UNIT

(75) Inventors: Gerhard Blum, Gutach (DE); Hermann Grether, Müllheim (DE); Georg Städtler, Müllheim (DE); Alexander Stein, Ihringen (DE); Christoph Weis, Müllheim (DE); Oliver Denzler, Bottmingen (CH)

(73) Assignee: Neoperl GmbH, Mullheim (DE)

( * ) Notice: Subject to any disclaimer, the term of this patent is extended or adjusted under 35 U.S.C. 154(b) by 254 days.

(21) Appl. No.: 13/304,797

(22) Filed: Nov. 28, 2011

(65) Prior Publication Data

US 2013/0134239 A1 May 30, 2013

(51) Int. Cl.
*E03C 1/08* (2006.01)

(52) U.S. Cl.
USPC ..... 239/428.5; 239/419.5; 239/553.3; 239/580; 239/587.1; 239/587.4; 239/590; 239/590.3; 239/600; 239/DIG. 23

(58) Field of Classification Search
USPC ..... 239/419.5, 428.5, 575, 553–553.5, 239/590–590.5, 580, 600, 587.1, 587.3, 239/587.4, DIG. 23
See application file for complete search history.

(56) References Cited

U.S. PATENT DOCUMENTS

| | | | | |
|---|---|---|---|---|
| 3,014,667 | A | 12/1961 | McLean et al. | |
| 4,534,513 | A | 8/1985 | Aghnides | |
| 4,534,514 | A | 8/1985 | Aghnides | |
| 4,637,552 | A * | 1/1987 | Finkbeiner et al. | 239/428.5 |
| 6,902,123 | B2 * | 6/2005 | Grether et al. | 239/428.5 |
| 7,677,473 | B2 * | 3/2010 | Kao | 239/428.5 |
| 2002/0084353 | A1 | 7/2002 | Griffin et al. | |
| 2008/0111007 | A1 * | 5/2008 | Grether | 239/428.5 |

FOREIGN PATENT DOCUMENTS

| | | |
|---|---|---|
| CH | 380042 | 8/1964 |
| DE | 9314990.5 | 1/1994 |
| DE | 102005010551 | 5/2007 |
| DE | 102010048701 | 3/2012 |
| DE | 102010048702 | 3/2012 |
| EM | 001251946 | 12/2010 |
| EM | 001282065 | 6/2011 |
| EM | 001289961 | 8/2011 |
| WO | 2006094680 | 9/2006 |

* cited by examiner

*Primary Examiner* — Steven J Ganey
(74) *Attorney, Agent, or Firm* — Volpe and Koenig, P.C.

(57) ABSTRACT

A sanitary functional unit with a housing releasably fastened to the water outlet of a sanitary outlet fitting, the housing having an outflow-side housing end face with outflow openings. The outflow-side housing end face has at least one slot, opposing longitudinal sides of which form turning engagement surfaces or tool engagement surfaces for a turning tool that is releasably inserted into the slot, and the housing of the functional unit is rotatably held on the water outlet of the outlet fitting and/or the housing end face is mounted rotatably in the housing. Using the turning tool in the slot, a pivotably mounted housing end face in the housing can be easily aligned and/or the turning force required for fitting and removing a screw connection provided between the outer housing periphery and the inner fitting periphery can be conveniently transferred to the housing without requiring special turning tools.

17 Claims, 12 Drawing Sheets

SANITARY FUNCTIONAL UNIT

BACKGROUND

The invention relates to a sanitary functional unit which has a housing which can be releasably fastened to the water outlet of a sanitary outlet fitting, the housing having an outflow-side housing end face with outflow openings.

There are already various known sanitary functional units which can be releasably fastened to the outlet end of a sanitary outlet fitting in order to form and/or regulate the water jet emerging there. For example, jet regulators intended to form the outflowing water into a homogeneous, non-splashing and possibly also effervescent-soft water jet have been created. These functional units, formed for example as jet regulators, have a housing which has a housing end face that is on the outflow side, is designed for example as a flow straightener and has a large number of outflow openings. To be able to fit such previously known functional units on the outlet end of the outlet fitting, functional units which bear on the outer housing periphery of their housing an external thread with which the housing can be screwed in by an internal thread provided on the inner periphery of the outlet fitting have already been created. To be able to apply to the housing the turning force required for screwing the corresponding threads, profilings which serve as turning engagement surfaces or tool engagement surfaces for a turning tool are provided at the peripheral edge on the outflow-side end or in the region of the peripheral edge of the housing. Since the previously known functional units often do not require maintenance over many months, the required turning tool is frequently mislaid over the months, with the result that it is not readily available when required.

The applicant's German utility model 93 14 990 discloses a jet aerator which has in its fitting housing a perforated plate serving as a jet splitter, which has a number of throughflow holes for producing a large number of individual jets. Provided in the outflow region of the throughflow holes are pins, the end of which that is free, narrows conically to a point and points towards the perforated plate being formed as a deflection slope which respectively deflects at an angle to the direction of flow one of the individual jets coming from the throughflow holes. To be able to fit the fitting housing of this previously known jet aerator on the water outlet of a sanitary outlet fitting, a sleeve-like outlet mouthpiece into which the fitting housing can be inserted up to an insertion stop is provided. Provided on the outlet mouthpiece is a thread, which can be screwed with a corresponding mating thread on the water outlet.

The outer appearance of the outlet fitting is determined by the water outlet and the adjacent outlet mouthpiece and the screw connection thereof to the water outlet. To create an aesthetically pleasing appearance, it is required to make the visible surfaces of the outlet mouthpiece on the one hand and of the outlet fitting in the region of its water outlet on the other hand as uniform as possible. Nevertheless, a narrow gap remains between the outlet mouthpiece and the jet regulator insert, tends to become soiled and may have a detrimental effect.

Therefore, likewise serving as a jet aerator, a sanitary fitting with a multipart fitting housing, which has on its outer housing periphery an external thread for screwing into an internal thread provided on the inner periphery of the water outlet of a sanitary outlet fitting, has also been created (cf. DE 10 2005 010 551 A1). Formed onto the fitting housing on the outflow side is a flow straightener, which is formed as a perforated plate which has throughflow holes and forms the outflow-side housing end face. A number of grid-like insert parts, which serve as a jet regulating device designed to re-form the individual jets aerated in the housing interior into a homogeneous, non-splashing combined jet can be inserted into the housing interior of the fitting housing. The edge on the outflow-side end of the housing has a profiling which may serve as a tool engagement surface for the corresponding profiling of a further fitting housing used as a turning tool. Since the jet aerator previously known from DE 10 2005 010 551 A1 can be screwed so far into the water outlet of a sanitary outlet fitting that the outflow-side housing end face of the fitting housing does not protrude beyond the water outlet of the outlet fitting, the aesthetic impression is determined by the outlet fitting alone. To be able to fit or remove the fitting housing onto or from the water outlet of the outlet fitting, however, a further fitting housing or another special turning tool is always required and may not always be available, especially in a household.

U.S. Pat. No. 4,534,513 also discloses a jet regulator with a sleeve-like fitting housing which bears on its outflow-side housing periphery an external thread with which the fitting housing can be screwed onto an internal thread provided on the inner periphery of the water outlet of the outlet fitting. The fitting housing has an outflow-side housing end face which is formed by superposed layers of metal screens and is displaceably guided in the housing interior of the fitting housing. By applying a coin to this outflow-side housing end face, the housing end face is pushed forward into the housing interior in such a way as to expose a slot accepting the narrow side of the coin and serving as a tool engagement surface for the coin used as a turning tool. However, the displaceability of the housing end face has the consequence that the flow conditions in the housing interior of the previously known jet regulator can change, so that the previously known jet regulator possibly does not have a jet of consistent quality, particularly does not have a jet of a consistently good quality, and requires considerable installation space.

Comparable jet regulators which have tool engagement surfaces for a simple turning tool on their outflow-side housing end face are also disclosed by WO 2006/094680 A1, CH-A 380 042, US 2002/0084353A1, U.S. Pat. No. 3,014,667 and U.S. Pat. No. 4,534,514.

Jet regulators have also already been created with a jet regulator housing of which the outflow-side housing end face has a hemispherical peripheral edge region, which is pivotably mounted in a partial region of the jet regulator housing that is designed as a joint socket in such a way that the emerging water jet can be aligned with respect to the point of impingement in the downstream washbasin. In this case, a stick-like manual adjusting element is provided on the outflow side of the housing end face, protruding outwards in a detrimental manner and possibly also causing undesired manipulations to occur on the housing end face. If there is no visually discernible feature on the outlet end face, it is not clear to an unpractised or uncertain user that the water jet can be set in its direction by actuating the outlet end face.

SUMMARY

The invention therefore particularly addresses the problem of providing a sanitary functional unit of the type mentioned at the beginning which avoids the disadvantages of the previously known prior art described above and which is distinguished by significantly simplified handling.

The solution to this problem according to the invention is particularly that the outflow-side housing end face has at least one slot, the opposing longitudinal sides of which slot are designed as turning engagement surfaces or tool engagement surfaces for a turning tool that can be releasably inserted into the at least one slot, and that the housing of the functional unit is rotatably held on the water outlet of the outlet fitting and/or the housing end face is mounted rotatably in relation to the housing on said housing.

The functional unit according to the invention has on its housing end face that is on the outflow side and has the outflow openings at least one slot which is open on the outflow side and the opposing longitudinal sides of which slot are designed as turning engagement surfaces or as tool engagement surfaces for a turning tool which can be releasably inserted into the at least one slot. In this case, the housing of the functional unit is rotatably held on the water outlet of the outlet fitting in such a way that, for example, a screw or bayonet connection provided between the outer housing periphery and the inner periphery of the outlet fitting surrounding the outlet end can be turned between a release position and a hold position. In addition or instead of this, the housing end face may be mounted rotatably in relation to the housing on said housing, in order for example to be able to adjust the adjusting elements located in the housing interior or to be able to adjust and align the housing end face and the throughflow openings provided on it in relation to the longitudinal axis of the housing. The slot allows the simplest of turning tools that are usually readily available in a household to be used for assistance. At the same time, the slot is unobtrusively integrated in the housing end face, so that the slot is less likely to cause unauthorized or undesired manipulations to the functional unit.

The functional unit according to the invention therefore always has on its outflow-side housing end face at least one slot, the opposing longitudinal sides of which slot serve as turning engagement surfaces or tool engagement surfaces for a turning tool that can be inserted into the slot.

In one embodiment of the subject matter of the invention, the housing of the functional unit is rotatably held on the water outlet of the outlet fitting, so that the turning force required for turning the housing can be applied by means of the turning tool inserted into the slot. A functional unit which bears on its outer periphery an external thread which interacts with an internal thread on the inner periphery of the water outlet can consequently be easily fitted onto or removed from the water outlet of the outlet fitting.

In another embodiment of the functional unit according to the invention, the housing end face is mounted rotatably in relation to the housing. In the case of such a functional unit, the turning tool can be inserted into the slot in order to bring the housing end face into the desired relative position with respect to the housing.

In a further embodiment according to the invention, which combines the two features described above of the subject matter of the invention with each other, the turning tool can be inserted into the at least one slot in order to change the relative position between the housing end face and the housing. If this relative position can be fixed in at least one turning position and/or in at least one turning direction, the housing itself can also be turned in its relative position with respect to the water outlet and, for example, be fitted and removed there by a screw connection or an insert/turn connection.

A screwdriver, for example, may be inserted into the slot as the turning tool. However, a preferred development according to the invention provides that the at least one slot is designed for inserting a partial region of a turning tool taking the form of a coin or for inserting a coin serving as the turning tool. A partial region of a turning tool taking the form of a coin or a coin used as a turning tool offers the advantage that the comparatively large flat sides of this turning tool are a good indication of the relative position of the housing, the housing end face and the water outlet. In particular, a coin is generally always available as a turning tool.

To be able to centre the coin or the partial region of a turning tool in the form of a coin quickly and easily in the position for use in the slot, it is advantageous if the at least one slot has a circular-segmental cross section in the direction of insertion.

To be able to place the turning tool quickly on the housing end face, it is expedient if at least two slots crossing each other are provided on the housing end face. In this respect, a preferred embodiment according to the invention provides that the slots are arranged crosswise in relation to each other and that the crossing point of the crossing slots is provided approximately midway along the longitudinal extent of at least one slot.

The at least one slot may be designed as a slot-like clearance in the housing end face. However, a preferred embodiment according to the invention that is distinguished by a high degree of stability of the housing end face even in the region of the slot provides that the at least one slot has a groove base which is of a closed design or of an open or liquid-permeable design—for example as a result of a perforated or grid structure forming the groove base.

The slot and the turning tool may serve various purposes.

Thus, one embodiment according to the invention envisages that the turning tool that can be inserted into the least one slot is provided for aligning by means of at least one turning movement the relative position between the housing and the end face of said housing rotatably mounted thereon.

In addition to or instead of this aligning function of the slot and the turning tool, they may also be intended for fitting and/or removing the functional unit into or from the water outlet of the sanitary outlet fitting. A development according to the invention in this respect is that the turning tool that can be inserted into the least one slot is intended for fitting and/or removing the functional unit that can be releasably fitted onto and/or removed from the outlet end of the outlet fitting by an inserting/turning movement or a turning movement.

To be able to change the relative position of the housing end face with respect to the housing, it is expedient if the housing end face is guided in the outflow-side end plane of the functional unit rotatably about the longitudinal axis of the housing and/or mounted pivotably about any desired pivot axis oriented transversely in relation to the longitudinal axis of the housing.

To be able to fasten the functional unit that can be inserted into the outlet fitting in an easily releasable manner there by means of a simple screw connection, it is advantageous if an external thread is provided on the outer housing periphery of the housing and interacts with an internal thread on the inner periphery of the outlet fitting, and if the turning force required for screwing in and unscrewing the threads can be transferred to the housing by way of the at least one slot.

To be able to give the housing end face sufficient stability in the region of the slot and make the slot sufficiently deep in order that a turning tool can engage in it firmly and securely, it is advantageous if the housing end face has a cross-sectional thickening, at least in the region of the at least one slot.

At the same time, it has no influence on the internal elements located in the housing interior if the housing end face has a convex or similarly outwardly protruding shaping, and if this shaping is preferably centred in relation to the midpoint of the end face.

Easy handling of the functional unit according to the invention is facilitated if the at least one slot has a longitudinal extent aligned approximately radially in relation to the midpoint of the end face.

A preferred embodiment according to the invention envisages that the functional unit is formed as a jet regulator or has a jet regulator of which the outflow side forms the outflow-side housing end face of the functional unit.

If the outflow-side housing end face of the functional unit according to the invention is rotatably and/or pivotably mounted in the housing, the emerging water jet can be changed in its direction of emergence. A preferred embodiment in this respect according to the invention envisages that on the inflow side of the housing end face there is provided at least one spacer, which is preferably arranged on a centre line running through the centre of the housing end face, lies against a perforation, grid or mesh structure or similar flow-forming part arranged upstream in the direction of flow and defines a pivot axis about which the housing end face can be tilted or pivoted in the chosen relative position or turning position of the housing and the housing end face.

In this case, not only the relative position of the housing end face on the one hand and the housing on the other hand can be pivoted and/or turned, —but also the fitting or removal of the housing held in the water outlet by means of a screw connection or an insert/turn connection is facilitated if on the outflow side of the flow-forming part there protrudes at least one turning stop, which in at least one relative position or turning position of the housing and the housing end face lies against the at least one spacer in such a way that the housing and the housing end face are connected to turn with each other.

To be able to identify the pivot axis of the housing end face better and facilitate alignment of the emerging water jet, it is advantageous if at least one slot is arranged axially parallel or offset by 90° in relation to the at least one spacer provided on the inflow side of the housing end face.

BRIEF DESCRIPTION OF THE DRAWINGS

Developments according to the invention are provided by the claims and the description in conjunction with the figures. The invention is also described in more detail below on the basis of preferred exemplary embodiments. In the figures:

DETAILED DESCRIPTION OF THE PREFERRED EMBODIMENTS

Figure 13:
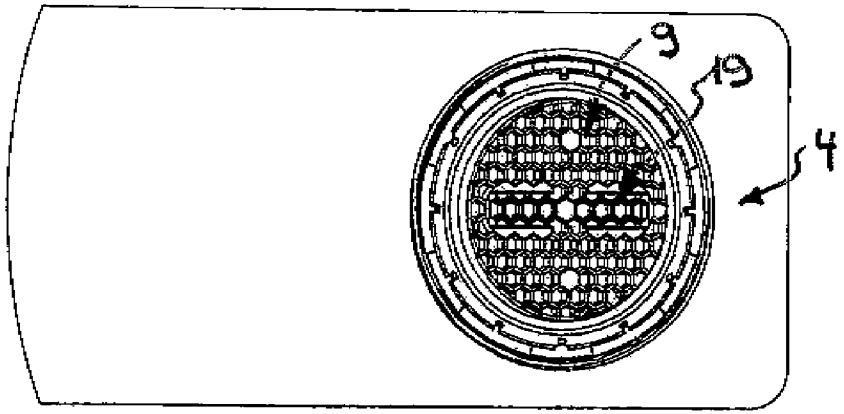
FIG. 13 shows the water outlet with the jet regulator from FIG. 11 in a plan view of the outflow-side housing end face.
Figure 12:
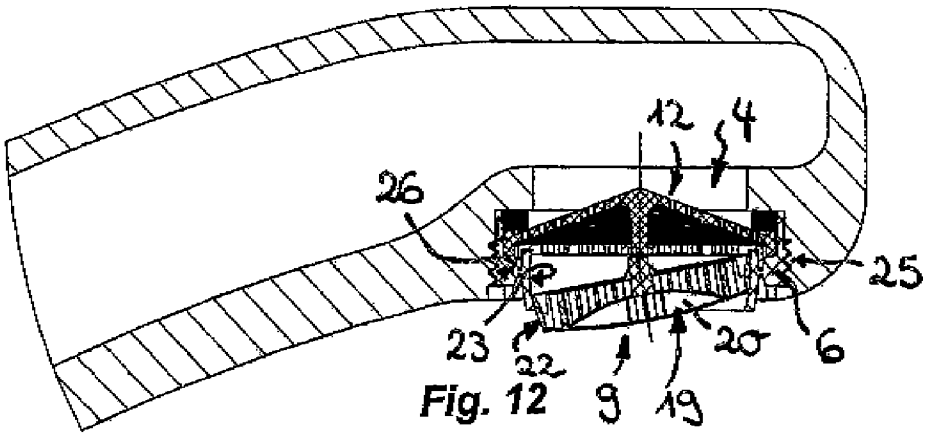
FIG. 12 shows a jet regulator that can be releasably fitted into the water outlet of a sanitary outlet fitting, similar to that from FIGS. 6 to 11, in a longitudinal section.
Figure 18:
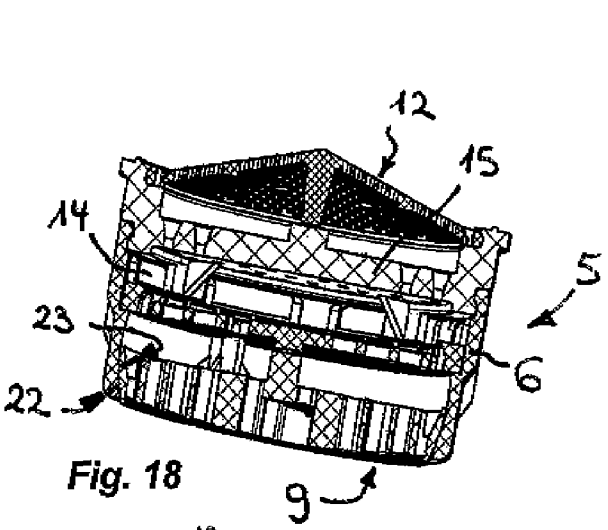
FIG. 18 shows the jet regulator from FIGS. 16 and 17 in a perspectively represented longitudinal section.
Figure 19:
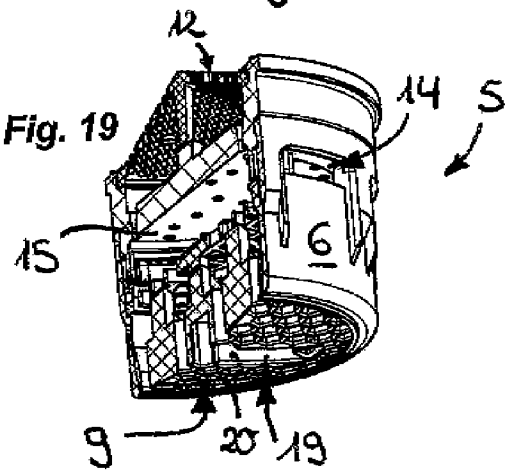
FIG. 19 shows the jet regulator from FIGS. 16 to 18 in a perspective longitudinal section turned with respect to FIG. 18.
Figure 17:
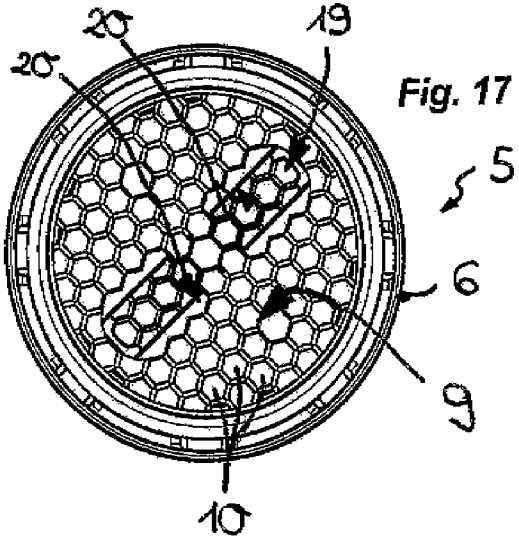
FIG. 17 shows the jet regulator from FIG. 16 in a plan view of its outflow-side housing end face.
Figure 16:
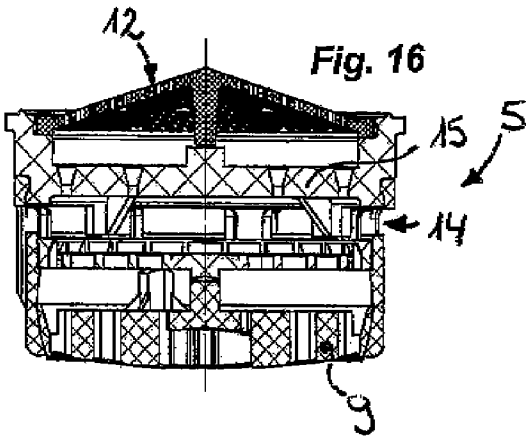
FIG. 16 shows a jet regulator represented in a longitudinal section, which can be releasably fastened to the water outlet of a sanitary outlet fitting by means of a sleeve-like outlet mouthpiece not represented here any further, the outflow-side housing end face of the jet regulator here too being pivotably mounted in the housing.
Figure 21:
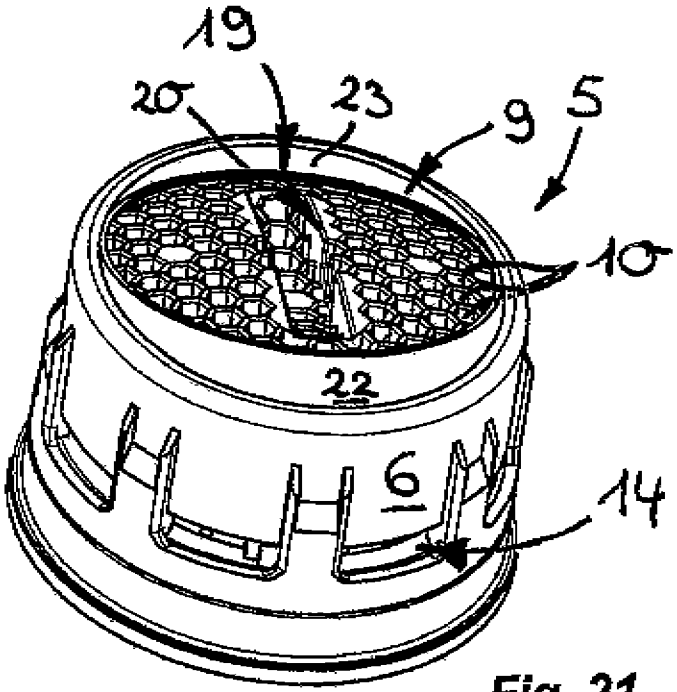
FIG. 21 shows the jet regulator from FIGS. 16 to 20 in a perspective plan view of the housing end face that is on the outlet side and is shown here in a pivoted position.
Figure 20:
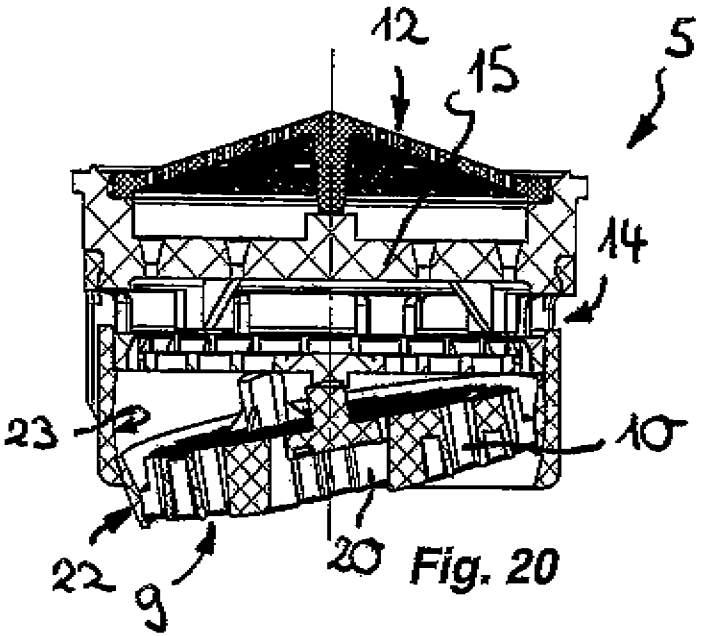
FIG. 20 shows the jet regulator from FIGS. 16 to 19 in a longitudinal section, the outflow-side housing end face being shown here in a pivoted position angled away with respect to the longitudinal axis of the housing.

Various embodiments 1, 2, 3, 4, 5, 40, 41 and 42 of a sanitary functional unit are represented in FIGS. 1 to 26. The functional units 1, 2, 3, 4, 5, 40, 41 and 42 have a housing 6, which can be releasably fastened to the water outlet 7 of a sanitary outlet fitting 8 (cf. FIGS. 12 and 13). The housing 6 has an outflow-side housing end face 9, which has a large number of outflow openings 10. The outflow openings 10 are surrounded by a honeycomb-like outlet structure, which forms at least a partial region of the housing end face 9.

The functional units 1, 2, 3, 4, 5, 40, 41 and 42 are formed here as a jet regulator or have such a regulator. While in the case of the functional units 1 and 2 according to FIGS. 1 to 5, between the outflow-side jet regulator 11 and an inflow-side attachment screen 12 there is arranged a rate-of-flow regulator 13, which is intended to limit the water flowing through to a maximum volume flowing through per unit of time independently of the water pressure, the functional units 3, 4, 5 and 42 according to FIGS. 6 to 21 and FIG. 26 are formed as a jet regulator which is merely preceded by an attachment screen 12 for filtering out any particles of dirt that are possibly entrained in the water. The jet regulators 40, 41 represented in FIGS. 22 to 25 manage without such an attachment screen.

With the jet regulators represented here, which are designed as aerated jet regulators, the water emerging from the water outlet is intended to be formed into a homogeneous, non-splashing and effervescent-soft water jet. For this purpose, the jet regulators have an inflow-side jet splitter, which divides the inflowing water into a large number of individual jets; this produces a negative pressure on the outflow side of the jet splitter, with the effect of sucking in ambient air, which can penetrate into the housing interior of the housing 6 through housing or aeration openings 14 and be mixed there with the water flowing through.

The jet splitter may be formed, for example, as a perforated plate 15 or as a cup-shaped diffuser 16, on the peripheral wall of which cup throughflow openings 17 are provided and the base of which cup is designed as an impinging and deflecting surface 18 leading to the throughflow openings 17. The individual jets coming from the jet splitter and enriched here with ambient air are re-formed in an outflow-side flow straighter into a homogeneously emerging combined jet, the housing end face 9 forming the flow straightener.

It can be seen in FIGS. 1 to 26 that on the outflow-side housing end face 9 of each functional unit 1, 2, 3, 4, 5, 40, 41 and 42 there is provided at least one slot 19, the opposing longitudinal sides 20 of which slot are designed as turning engagement surfaces or tool engagement surfaces for a turning tool that can be releasably inserted into the at least one slot 19. In FIG. 5, it is indicated by a dash-dotted line that a partial region of a turning tool taking the form of a coin, or preferably a coin 21 serving as the turning tool, can be inserted into the at least one slot 19.

The at least one slot 19 is formed here as a groove, the base of which groove, provided on the side remote from the slot opening, is of a closed design or of a liquid-permeable or open design—as here for example as a result of a perforated structure in the groove base. To be able to align a coin 21 inserted in the slot 19, it is expedient that the at least one slot 19 forms a circular-segmental depression in the direction of insertion.

The slot 19 and the turning tool may serve various purposes.

Thus, in the case of the functional units 3, 4, 5, 40 and 41 represented in FIGS. 7 to 25, the turning tool is provided for aligning the relative position between the housing end face 9 and the housing 6 by means of a turning and/or pivoting movement.

As can be seen from FIGS. 7 to 25, the housing end face 9 is for instance rotatably guided in the outflow-side end plane of the functional units 3, 4, 5, 40 and 41 and mounted pivotably or tiltably about any desired pivot axis oriented transversely in relation to the longitudinal axis of the housing. For this purpose, the outer periphery 22 of the housing end face 9, designed in the form of a plate, is designed in a hemispherical form and is held pivotably in a joint socket 23 of a complementary form, which is formed by a partial region of the inner peripheral wall of the housing 6. In this case, the pivot axis may be formed by spacers 43, which protrude on the inflow side of the housing end face 9 and lie against a flow-forming part 44 arranged upstream in the direction of flow in such a way that these spacers 43 form a pivot axis about which the housing end face 9 can be tilted or pivoted.

By turning, pivoting or turning and pivoting the housing end face 9 in relation to the housing 6, the emerging water jet can be aligned with respect to the point of impingement in the washbasin. For this purpose, the walls surrounding the outflow openings 10 are designed as flow-guiding walls 24, which preferably have a greater height in comparison with the clear diameter.

In addition to or instead of the aforementioned aligning function, the turning tool that can be inserted in the at least one slot 19 may be intended for fitting and/or removing the functional unit that can be releasably fitted onto and removed from the water outlet of the outlet fitting by an inserting/turning movement or a turning movement. For this purpose, the functional units 1, 2, 3, 4, 41 and 42 have on the outer housing periphery of their housing 6 an external thread 25, which interacts with an internal thread 26 (cf. FIG. 12) on the inner periphery of the outlet fitting. The turning force required for screwing in and unscrewing the threads 25, 26 can be transferred to the housing 6 by way of the at least one slot 19.

While in the case of the functional units 1, 2, 40 and 42, the turning tool and the slot 19 only serve one purpose, the slot 19 in the case of the functional units 3, 4 and 41 shown in FIGS. 6 to 15 and 24 to 25 is required both for aligning the outflow-side housing end face 9 and for fitting and removing the housing 6 onto and from the water outlet of the outlet fitting. Since, in the case of the functional units 3, 4, 40 and 41, the housing end face 9 is rotatably and/or pivotably mounted in the housing 6, turning stops 45, which in one turning position of the housing end face 9 interact with the spacers 43, are provided on the flow-forming part 44, which is arranged upstream in the direction of flow, is connected to the housing 6 to turn therewith and is formed as a grid or mesh structure or—as here—as a perforated structure. If the spacers 43 lie against these turning stops 45, the applied turning force is converted into a screwing-in or unscrewing movement of the screw connection provided between the outer housing periphery and the inner fitting periphery.

In the case of the functional unit shown in FIGS. 16 to 21, only the outflow-side housing end face 9 is pivotably mounted in the housing 6 in such a way that the emerging water jet can be aligned with respect to the downstream washbasin. To be able to fasten the functional unit 5 according to FIGS. 16 to 21 releasably to the water outlet of a sanitary outlet fitting, an outlet mouthpiece that is in fact customary but is not represented any further here is required. The housing 6 of the functional unit 5 can be inserted into the sleeve-like outlet mouthpiece in order subsequently to fasten the outlet mouthpiece releasably to the outlet end of the sanitary outlet fitting.

To make the housing end face 9 stable even in the region of the slot 19, it is advantageous if the housing end face has a cross-sectional thickening, at least in the region of the at least one slot 19. It can be seen in FIGS. 1 to 26 that, for this purpose, the housing end face 9 has here a convex, outwardly protruding shaping, this shaping being centred in relation to the midpoint of the housing end face 9. The convex shaping allows the slot 19 to reach comparatively far into the housing end face 9, without the housing interior of the housing 6 that remains between the housing end face 9 and the jet splitter 15 being significantly restricted; therefore—as illustrated in FIG. 26, this housing interior is available for further insert parts, formed for example as grid- or mesh-like structures or as a perforated structure, which can be inserted into the housing interior if need be for jet regulating or jet forming.

The slot 19 has a longitudinal extent aligned approximately radially in relation to the midpoint of the end face.

Figure 3:
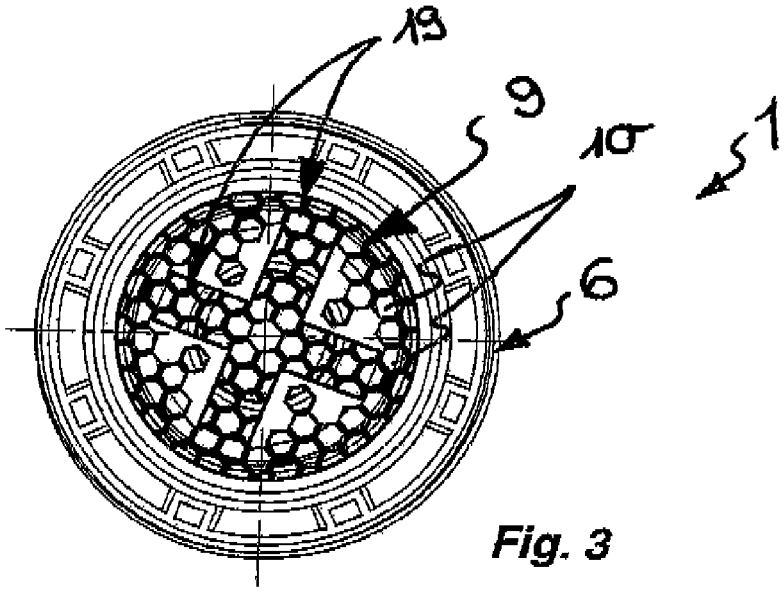
FIG. 3 shows the functional unit from FIGS. 1 and 2 in a plan view of its outflow-side housing end face.
Figure 4:
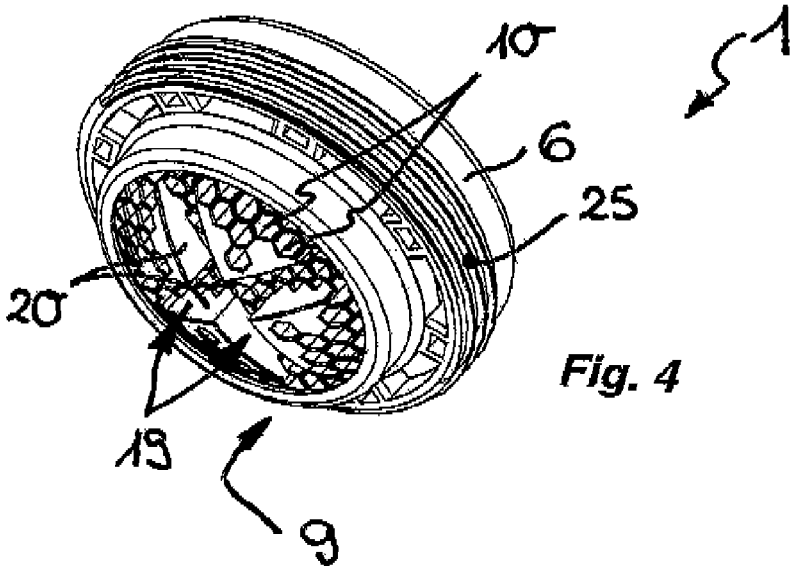
FIG. 4 shows the functional unit from FIGS. 1 to 3 in a perspective plan view of the housing end face.
Figure 5:
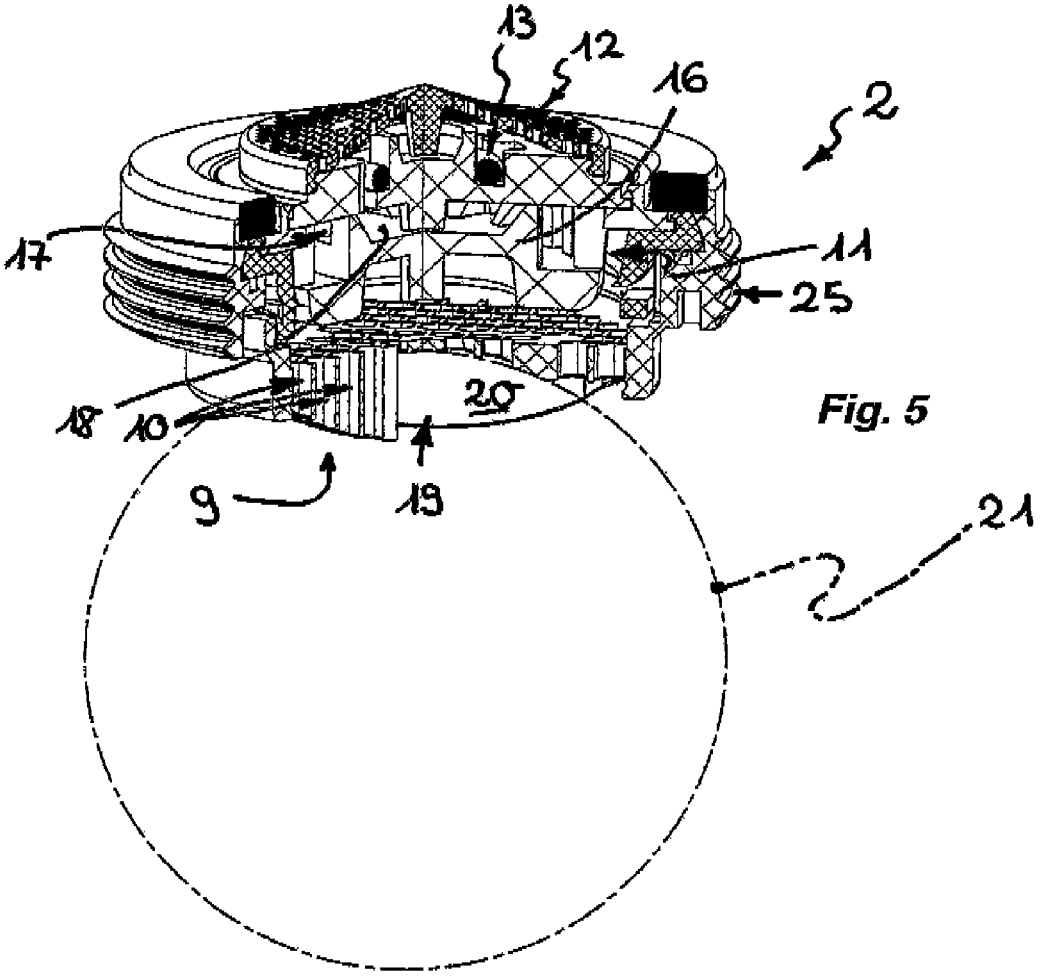
FIG. 5 shows a functional unit that is comparable to FIGS. 1 to 4 in a lateral partial longitudinal section, a coin having been inserted as a turning tool in the slot provided on the outflow-side housing end face.
Figure 8:
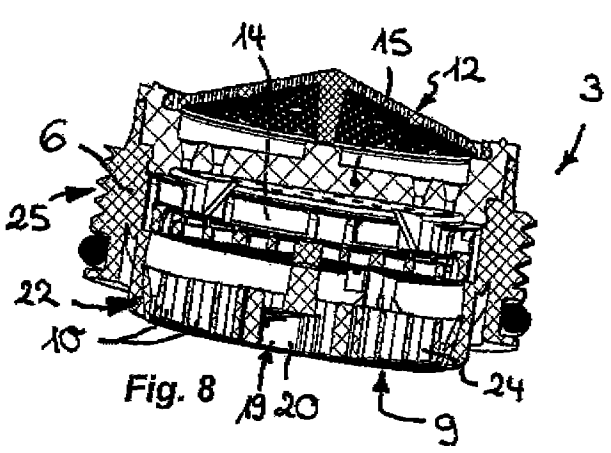
FIG. 8 shows the jet regulator from FIGS. 6 and 7 in a longitudinal section.
Figure 9:
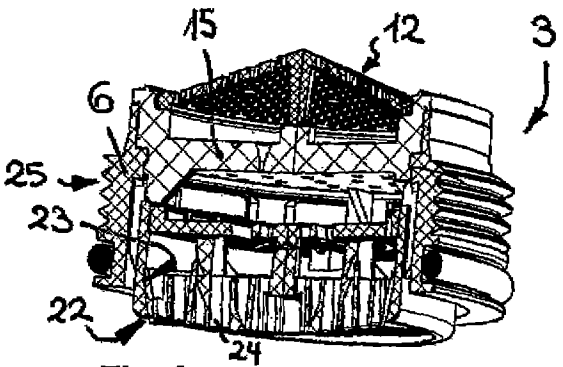
FIG. 9 shows the jet regulator from FIGS. 6 to 8 in a perspective partial longitudinal section.
Figure 7:
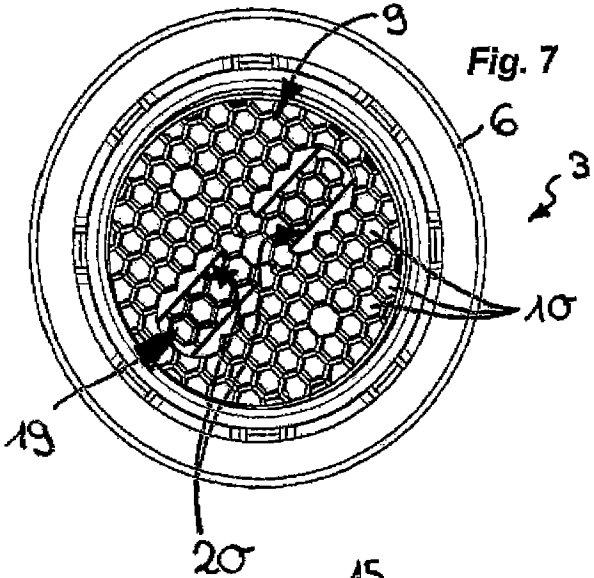
FIG. 7 shows the jet regulator from FIG. 6 in a plan view of its outflow-side housing end face.
Figure 6:
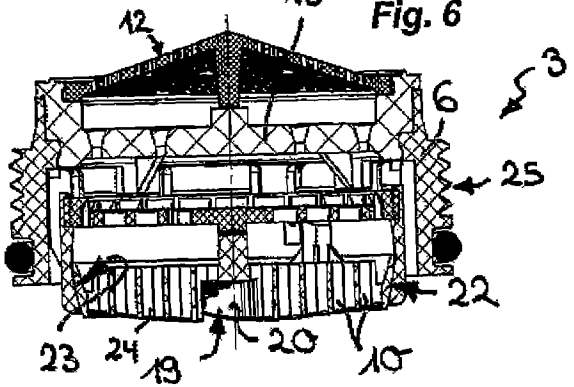
FIG. 6 shows a functional unit likewise formed as an aerated jet regulator, similar to those from FIGS. 1 to 5, in a longitudinal section, the housing end face additionally being pivotably mounted in the housing here, so that the turning tool that can be inserted into the slot of the housing end face can be used both for turning the screw connection provided between the outer housing periphery and the inner fitting periphery, and consequently for fitting and removing the functional unit, and for aligning the pivotably mounted housing end face.
Figure 11:
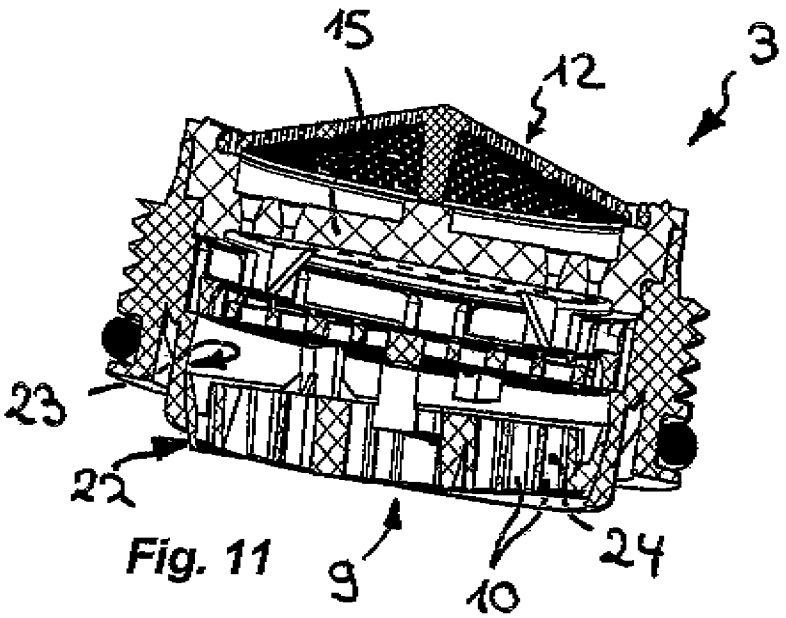
FIG. 11 shows the likewise longitudinally sectioned jet regulator from FIGS. 6 to 10 in a pivoted position of its housing end face differing from FIG. 10.
Figure 10:
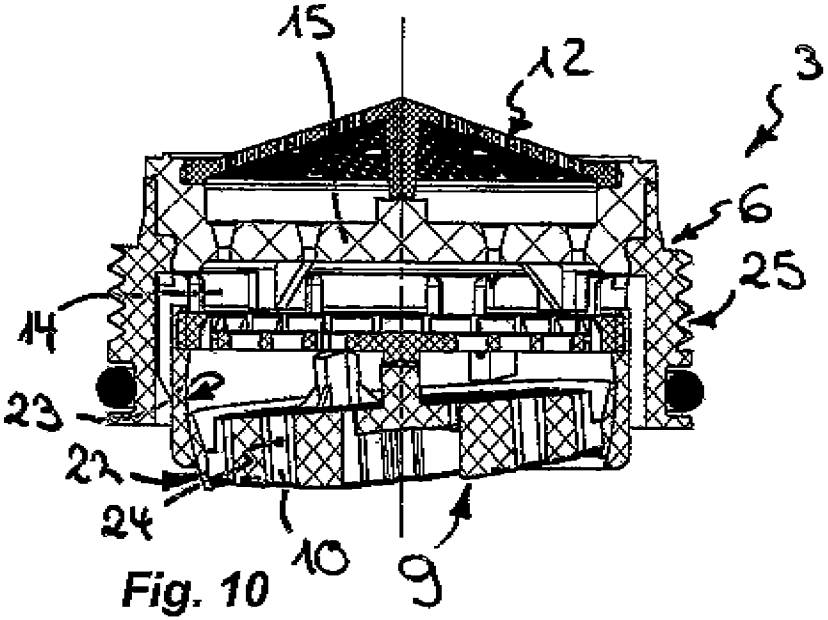
FIG. 10 shows the jet regulator from FIGS. 6 to 8, shown in a longitudinal section, in an angled-away pivoted position of its housing end face.
Figure 14:
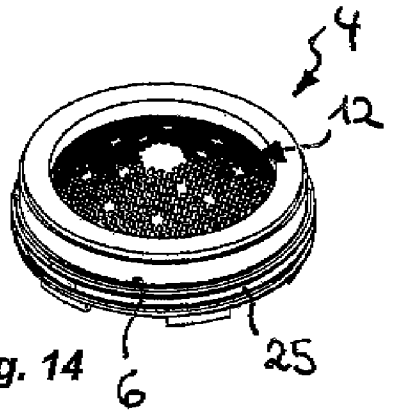
FIG. 14 shows the jet regulator from FIGS. 12 and 13 in a perspective plan view of the inflow side of its housing.
Figure 15:
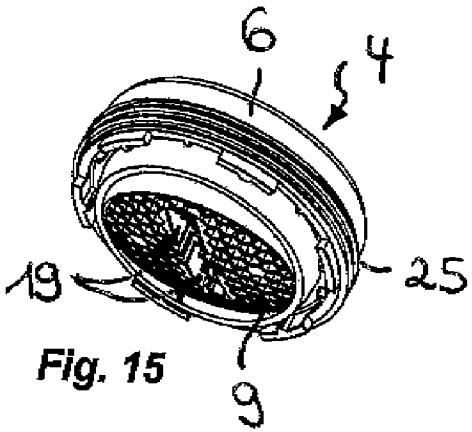
FIG. 15 shows the jet regulator from FIGS. 12 to 14 in a perspective plan view of the outflow-side housing end face, the housing end face being shown in a pivoted position angled away with respect to the housing.

It is clear from a comparison of FIGS. 3 and 4 on the one hand and FIGS. 15, 17, 21, 22 and 26 on the other hand that at least two slots 19 crossing each other can be provided on the housing end face 9. In the case of the functional unit 1, the slots 19 are arranged crosswise in relation to each other, the crossing point of the crossing slots 19 being provided approximately midway along the longitudinal extent of the slots 19.

In FIGS. 1 to 26, the functional units 1, 2, 3, 4, 5, 40, 41 and 42 are formed as a jet regulator or have such a jet regulator. However, it is also possible to design the outflow-side housing end face of other functional units, which are for example designed exclusively as rate-of-flow regulators or flow limiters, with a slot 19, which facilitates the handling and/or the fitting/removal of these functional units.

Figure 1:
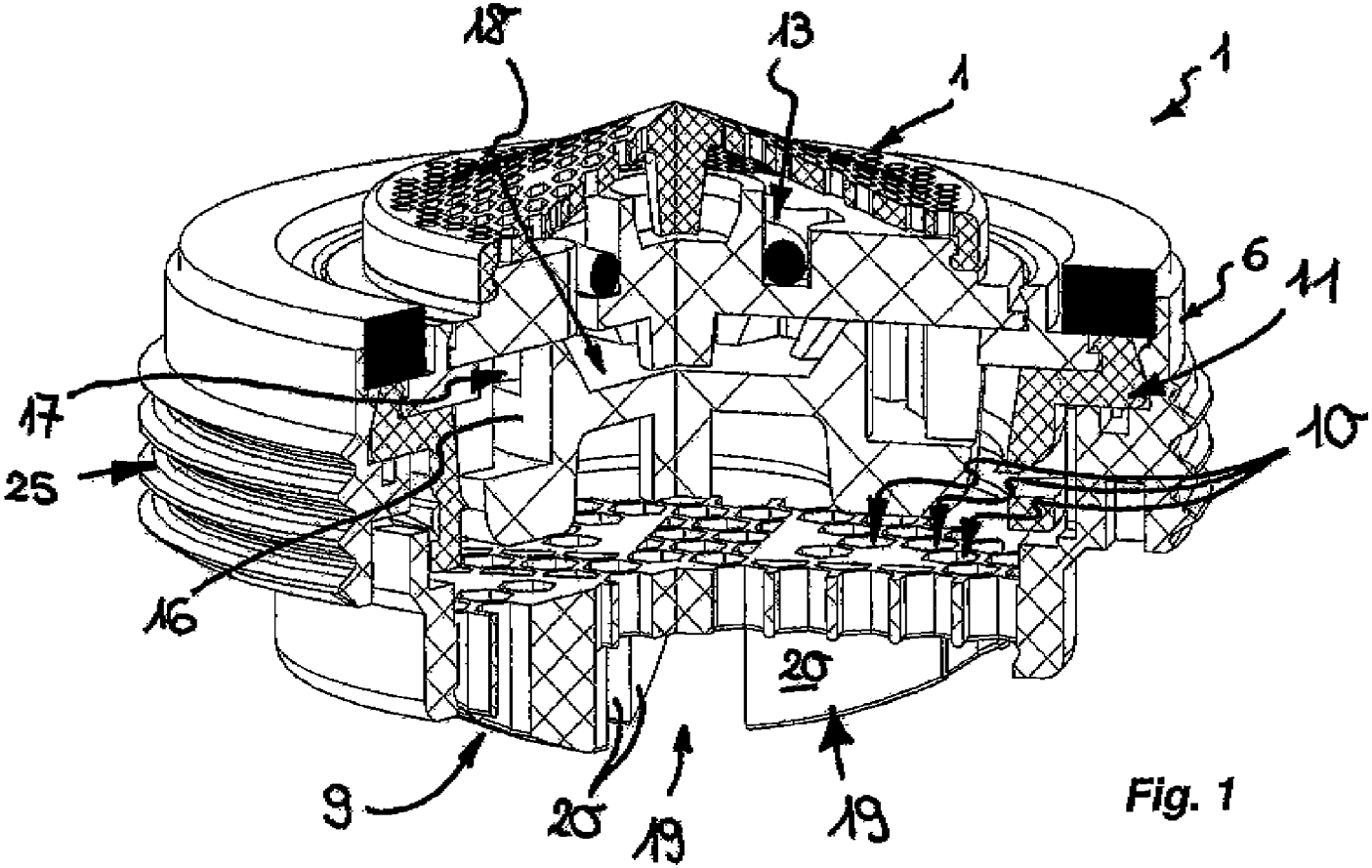
FIG. 1 shows a sanitary functional unit comprising an inflow-side attachment screen, an outflow-side jet regulator and a rate-of-flow regulator arranged in between, with a housing, the functional unit having on its outflow-side housing end face a crossing slot which is intended for inserting a turning tool in the form of a coin, and an external thread with which the housing can be releasably fastened in an internal thread provided on the inner periphery of the outlet fitting being provided on the outer housing periphery, and the turning tool being intended for fitting and removing the functional unit on and from the water outlet of the outlet fitting.
Figure 2:
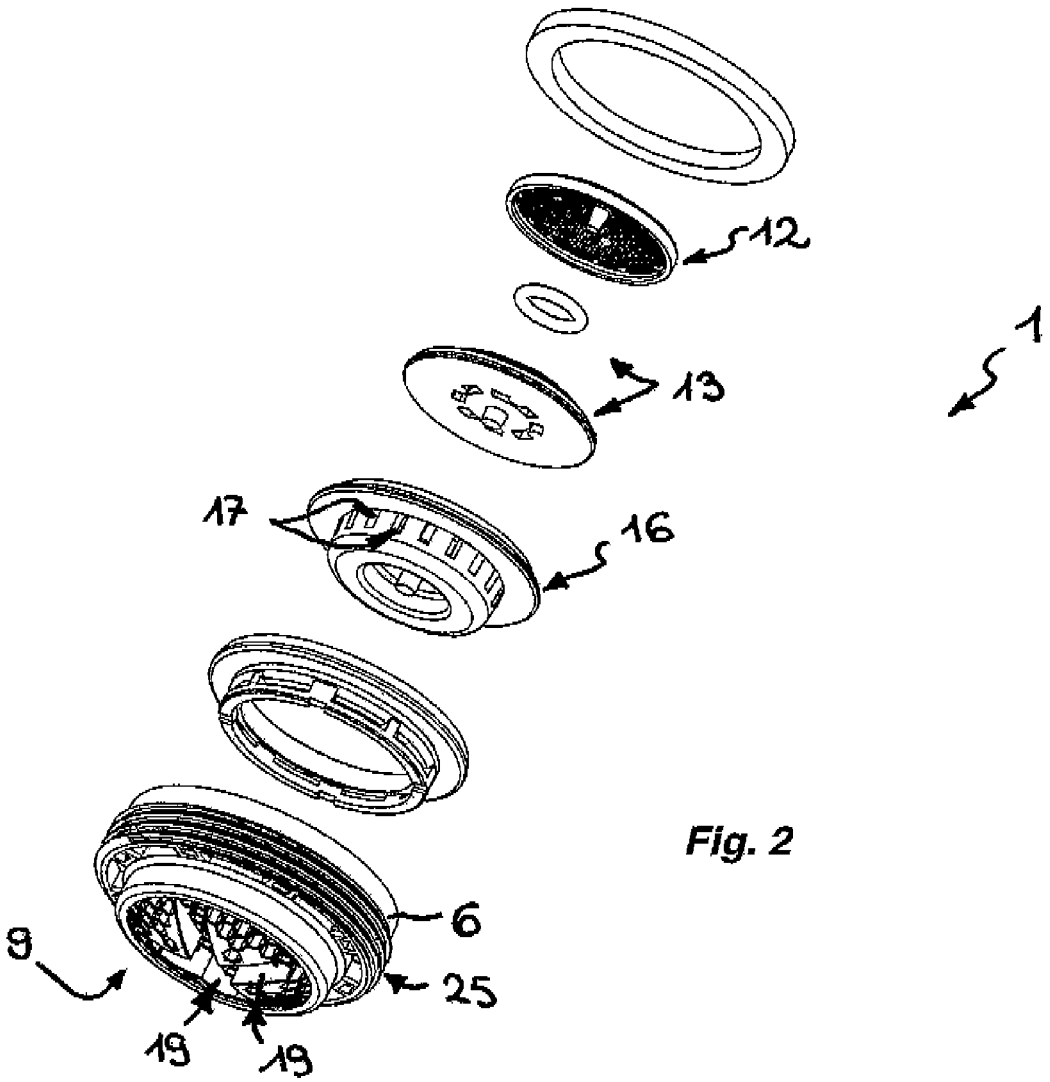
FIG. 2 shows the functional unit from FIG. 1 in an exploded perspective representation of the individual parts.

In FIG. 1 it can be seen that the perforated structure that is provided on the housing end face 9 outside the slot 19 is at such a distance from the slot that the longitudinal sides 20 of the slot have a greater wall thickness in comparison with the flow-guiding walls 24.

Figure 23:
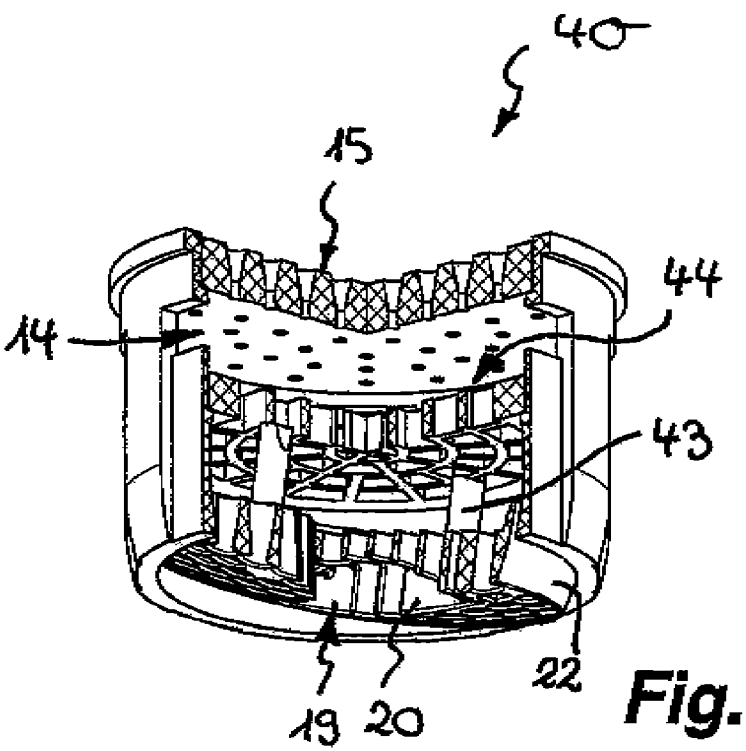
FIG. 23 shows the jet regulator from FIG. 22 in a perspective partial longitudinal section, two spacers that are formed on the inflow side of the outflow-side housing end face and protrude in a pin-like manner defining a pivot axis about which the housing end face can be tilted or pivoted.
Figure 22:
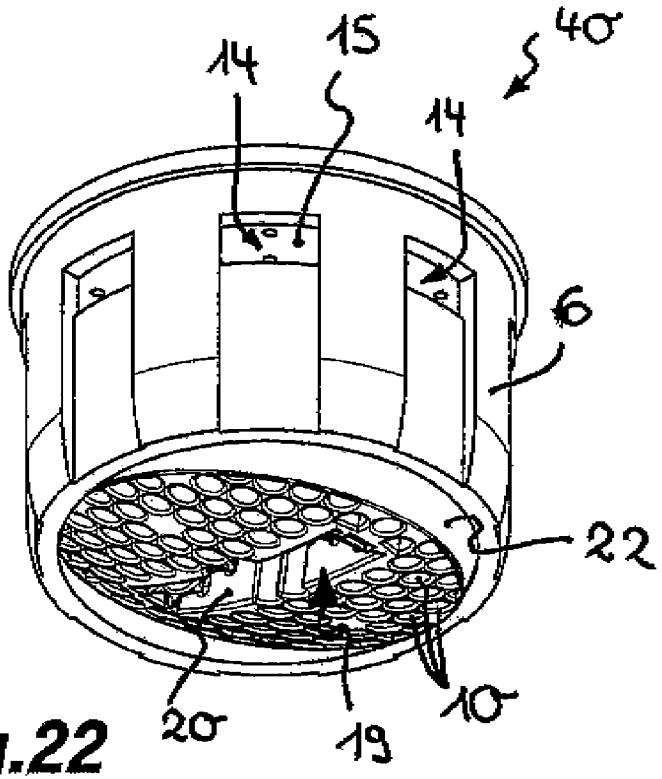
FIG. 22 shows a jet regulator which is comparable to FIGS. 16 to 21, is represented here in a side view and can be releasably fastened to the water outlet of a sanitary outlet fitting by means of a sleeve-like outlet mouthpiece not represented any further here, the outflow-side housing end face of the jet regulator here too being pivotably mounted in the housing.
Figure 25:
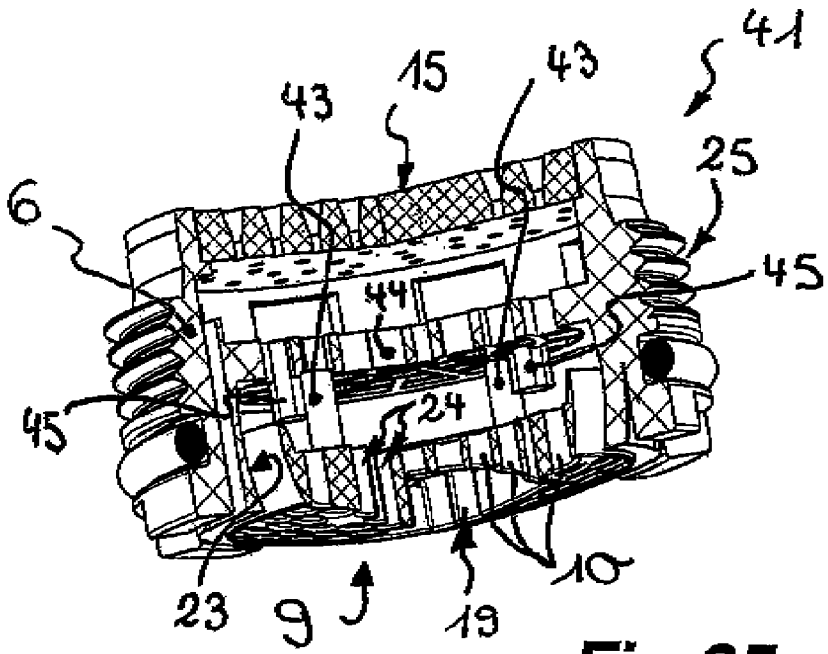
FIG. 25 shows the jet regulator from FIG. 4 in a perspective partial longitudinal section.
Figure 24:
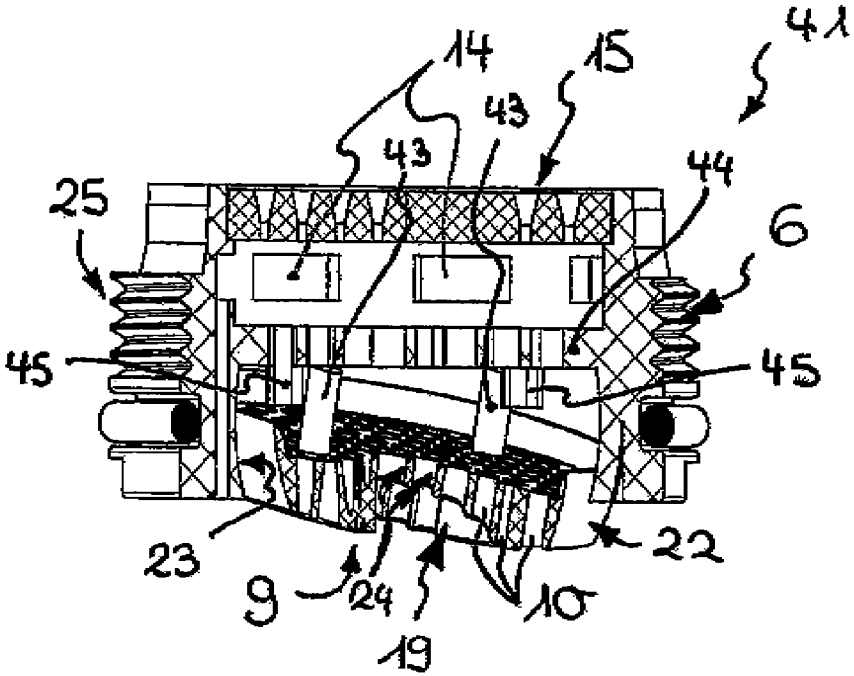
FIG. 24 shows a jet regulator that is comparable to FIGS. 6 to 11 and represented in a longitudinal section, the housing end face of which is pivotably mounted in the jet regulator housing, pin-like spacers being provided on the inflow side of the housing end face, interacting with turning stops on the outflow side of a perforated plate arranged upstream in the direction of flow in such a way that the housing end face can be turned between the turning stops in order to accomplish in one turning position a non-positive connection between the housing end face and the housing when the spacers lie against the turning stops.
Figure 26:
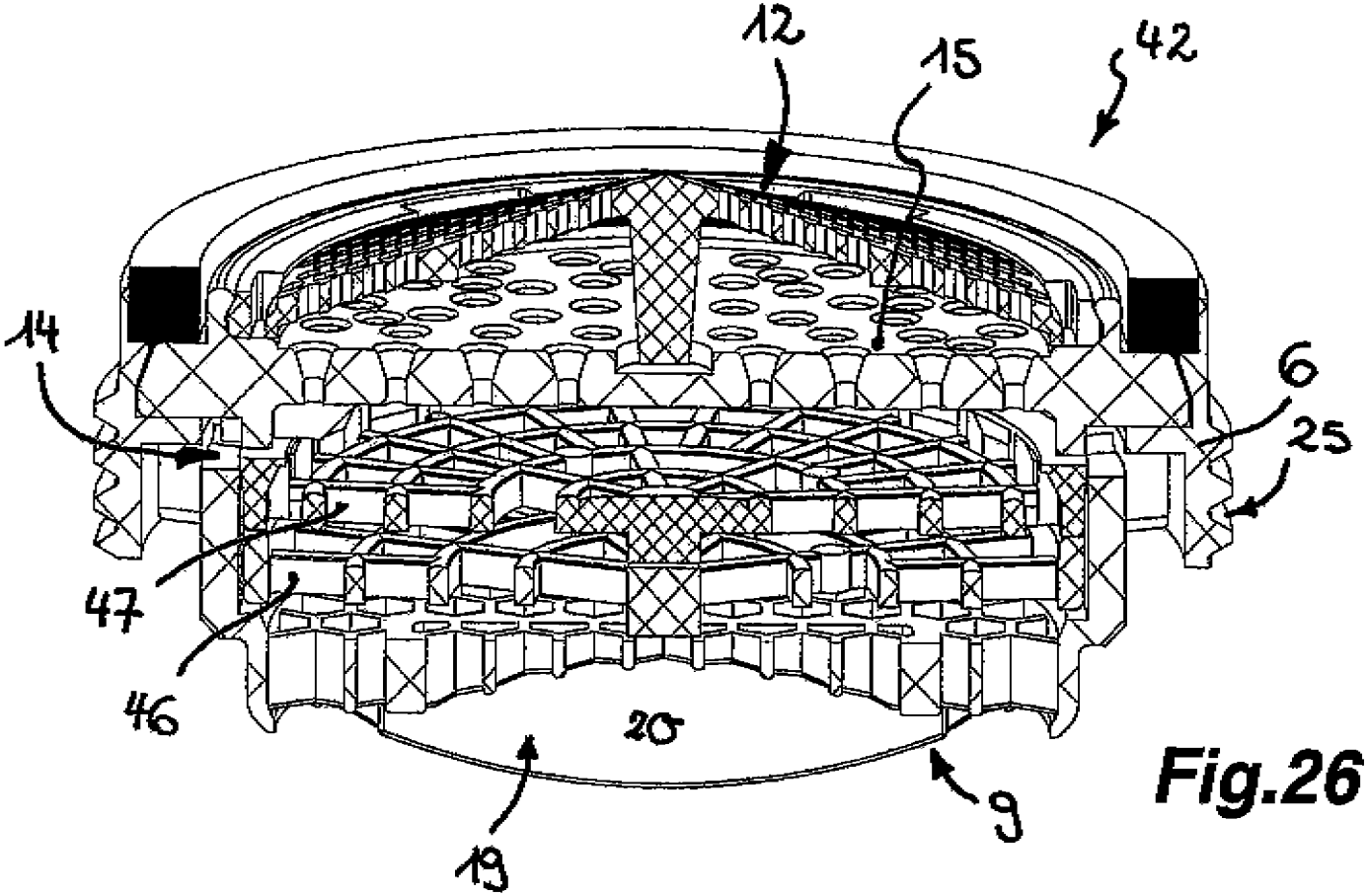
FIG. 26 shows a functional unit that is comparable to the functional units in FIGS. 1 to 5 and is formed as a jet regulator which bears an external thread on its jet regulator housing, a number of flow-forming parts that have a perforated, grid or mesh structure and are designed as insert parts having been inserted in the housing interior of the jet regulator housing.

It can be seen well in FIGS. 23 to 25 that on the inflow side of the housing end face two spaced-apart spacers 43 are provided, arranged on a centre line running through the centre of the housing end face 9. These spacers 43 lie against the flow-forming part 44 that is arranged upstream in the direction of flow and is formed here as an insert part in such a way that the spacers 43 define a pivot axis about which the housing end face 9 can be tilted or pivoted in the chosen relative position or turning position of the housing 6 and the housing end face 9. By turning the housing end face 9 in the joint socket 23 of the housing 6, the spacers 43 can be newly aligned, so that the pivot axis formed by the spacers 43 also changes in its relative position with respect to the housing 6. It can be seen in FIGS. 23 to 25 that on the outflow side of the flow-forming part 44 arranged upstream in the direction of flow there protrude two turning stops 45, which in at least one relative position or turning position of the housing 6 and the housing end face 9 lie against the spacers 43 in such a way that the housing 6 and the housing end face 9 are connected to turn with each other, in order to be able either to change the pivot axis of the housing end face 9 (cf. FIGS. 22 and 23) or else additionally fit or remove the corresponding functional unit 41 into or from the water outlet of the sanitary outlet fitting (cf. FIGS. 24 and 25).

The functional units 1, 2, 3, 4, 5, 40, 41 and 42 represented here therefore always have on their outflow-side housing end face 9 at least one slot 19, the opposing longitudinal sides 20 of which slot serve as turning engagement surfaces or tool engagement surfaces for a turning tool that can be inserted into the slot. In the embodiments shown in FIGS. 1 to 5 and 26, the housing 6 of the functional unit 1, 2, 42 is rotatably held on the water outlet of the outlet fitting, so that the turning force required for turning the housing can be applied by means of the turning tool inserted into the slot 19. These functional units 1, 2 and 42, which bear on the outer periphery of their housing 6 an external thread 25 which interacts with an internal thread on the inner periphery of the water outlet, can consequently be easily fitted onto or removed from the water outlet of the outlet fitting.

In a further embodiment not shown here, the housing end face 9 is merely mounted rotatably in relation to the housing 6. In the case of such a functional unit, the turning tool can be inserted into the slot 19 in order to bring the housing end face 9 into the desired relative position with respect to the housing 6.

In the embodiments shown in FIGS. 6 to 25, which combine the two features described above with each other, the turning tool can be inserted into the at least one slot 19 in order to change the relative position between the housing end face 9 and the housing 6. If in at least one turning position the spacers 43 lie against the turning stops 45 in such a way that this relative position of the housing end face 9 and the housing 6 is fixed, the housing 6 itself can also be turned in its relative position with respect to the water outlet. While the jet regulator 40 can be turned for this purpose in its outlet mouthpiece not represented any further here, the functional units 3, 4, 5 and 41 can be fitted in or removed from the water outlet by turning the housing 6.

The invention claimed is:

1. Sanitary functional unit (1, 2, 3, 4, 5, 40, 41, 42), comprising: a housing (6), which can be releasably fastened to a water outlet of a sanitary outlet fitting, the housing (6) having an outflow-side housing end face (9) with outflow openings (10), the outflow-side housing end face (9) has two slots (19) crossing each other located on the housing end face (9), the slots (19) are arranged crosswise in relation to each other and a crossing point of the crossing slots (19) is provided approximately midway along a longitudinal extent of at least one of the slots (19), opposing longitudinal sides (20) of the slots form turning engagement surfaces or tool engagement surfaces for a turning tool adapted to be releasably inserted into at least one of the slots, and the housing (6) of the functional unit (1, 2, 3, 4, 5, 40, 41, 42) is rotatably held on the water outlet of the outlet fitting or the housing end face (9) is mounted rotatably in relation to the housing (6) on said housing.

2. Functional unit according to claim 1, wherein at least one of the slots (19) is adapted for insertion of a partial region of a turning tool taking the form of a coin or for inserting a coin (21) serving as the turning tool.

3. Functional unit according to claim 1, wherein the slots (19) have a circular-segmental cross section in a direction of insertion.

4. Functional unit according to claim 1, wherein the slots (19) are formed as a groove, which has a groove base, which is of a closed design or of an open or liquid-permeable design as a result of a perforated or grid structure forming the groove base.

5. Functional unit according to claim 1, wherein the turning tool that can be inserted into at least one of the slots (19) is provided for aligning a relative position between the housing (6) and the housing end face (9) rotatably mounted thereon by at least one turning movement.

6. Functional unit according to claim 1, wherein the turning tool that can be inserted into at least one of the slots (19) is intended for at least one of fitting or removing the functional unit that is at least one of releasably fitted onto or removed from the water outlet of the outlet fitting by an inserting/turning movement or a turning movement.

7. Functional unit according to claim 1, wherein an external thread (25) is provided on the outer housing periphery of the housing (9) and interacts with an internal thread (26) on an inner periphery of the outlet fitting and a turning moment required for screwing in and unscrewing the threads (25, 26) can be transferred to the housing (6) by way of at least one of the slots (19).

8. Functional unit according to claim 1, wherein the housing end face (9) has a cross-sectional thickening, at least in a region of at least one of the slots (19).

9. Functional unit according to claim 1, wherein the functional unit (1, 2, 3, 4) is formed as a jet regulator or has a jet regulator, an outflow side of which forms the outflow-side housing end face (9) of the functional unit (1, 2, 3, 4, 5).

10. Sanitary functional unit (1, 2, 3, 4, 5, 40, 41, 42), comprising: a housing (6), which can be releasably fastened to a water outlet of a sanitary outlet fitting, the housing (6) having an outflow-side housing end face (9) with outflow openings (10), the outflow-side housing end face (9) has at least one slot (19), opposing longitudinal sides (20) of the slot form turning engagement surfaces or tool engagement surfaces for a turning tool adapted to be releasably inserted into the at least one slot, and the housing (6) of the functional unit (1, 2, 3, 4, 5, 40, 41, 42) is rotatably held on the water outlet of the outlet fitting or the housing end face (9) is mounted rotatably in relation to the housing (6) on said housing, wherein the housing end face (9) is at least one of rotatably guided in an outflow-side end plane of the functional unit or mounted pivotably about a pivot axis oriented transversely in relation to a longitudinal axis of the housing.

11. Functional unit according to claim 10, wherein the housing end face that can be at least one of turned or pivoted in the outflow-side end plane of the functional unit is fixable in at least one relative position of the housing (6) and the housing end face (9) in at least one of a turning position or a turning direction.

12. Functional unit according to claim 10, wherein the housing end face that can be at least one of turned or pivoted in the outflow-side end plane of the functional unit extends with at least one stop (43) against a counter-stop (45), connected to the housing, in at least one relative position of the housing (6) and the housing end face (9).

13. Sanitary functional unit (1, 2, 3, 4, 5, 40, 41, 42), comprising: a housing (6), which can be releasably fastened to a water outlet of a sanitary outlet fitting, the housing (6) having an outflow-side housing end face (9) with outflow openings (10), the outflow-side housing end face (9) has at least one slot (19), opposing longitudinal sides (20) of the slot form turning engagement surfaces or tool engagement surfaces for a turning tool adapted to be releasably inserted into the at least one slot, and the housing (6) of the functional unit (1, 2, 3, 4, 5, 40, 41, 42) is rotatably held on the water outlet of the outlet fitting or the housing end face (9) is mounted rotatably in relation to the housing (6) on said housing, wherein the housing end face (9) has a convex or outwardly protruding shape, and said convex or outwardly protruding shape is centered in relation to a midpoint of the housing end face.

14. Sanitary functional unit (1, 2, 3, 4, 5, 40, 41, 42), comprising: a housing (6), which can be releasably fastened to a water outlet of a sanitary outlet fitting, the housing (6) having an outflow-side housing end face (9) with outflow openings (10), the outflow-side housing end face (9) has at least one slot (19), opposing longitudinal sides (20) of the slot form turning engagement surfaces or tool engagement surfaces for a turning tool adapted to be releasably inserted into the at least one slot, and the housing (6) of the functional unit (1, 2, 3, 4, 5, 40, 41, 42) is rotatably held on the water outlet of the outlet fitting or the housing end face (9) is mounted rotatably in relation to the housing (6) on said housing, wherein the at least one slot (19) has a longitudinal extent aligned approximately radially in relation to a midpoint of the housing end face.

15. Sanitary functional unit (1, 2, 3, 4, 5, 40, 41, 42), comprising: a housing (6), which can be releasably fastened to a water outlet of a sanitary outlet fitting, the housing (6) having an outflow-side housing end face (9) with outflow openings (10), the outflow-side housing end face (9) has at least one slot (19), opposing longitudinal sides (20) of the slot form turning engagement surfaces or tool engagement surfaces for a turning tool adapted to be releasably inserted into the at least one slot, and the housing (6) of the functional unit (1, 2, 3, 4, 5, 40, 41, 42) is rotatably held on the water outlet of the outlet fitting or the housing end face (9) is mounted rotatably in relation to the housing (6) on said housing, wherein on an inflow side of the housing end face (9) there is provided at least one spacer (43), which is arranged on a center line running through a center of the housing end face (9), that lies against a perforation, grid or mesh structure or similar flow-forming part (44) arranged upstream in a direction of flow and defines a pivot axis about which the housing end face (9) can be tilted or pivoted in a chosen relative position or turning position of the housing (6) and the housing end face (9).

16. Functional unit according to claim 15, wherein on the outflow side of the flow-forming part (44) there protrudes at least one turning stop (45), which in at least one relative position or turning position of the housing (6) and the housing end face (9) lies against the at least one spacer (43) such that the housing (6) and the housing end face (9) are connected to turn with each other.

17. Functional unit according to claim 15, wherein the at least one slot (19) is arranged axially parallel or offset by 90° in relation to the at least one spacer (43) provided on the inflow side of the housing end face (9).

* * * * *